United States Patent [19]

Harris

[11] 4,092,746

[45] June 6, 1978

[54] SWIMMING POOL APPARATUS

[75] Inventor: Richard Harris, Archbold, Ohio

[73] Assignee: Mack and Gooding, Archbold, Ohio ; a part interest

[21] Appl. No.: 678,473

[22] Filed: Apr. 20, 1976

Related U.S. Application Data

[63] Continuation-in-part of Ser. No. 472,214, Mar. 22, 1974, abandoned.

[51] Int. Cl.[2] ..... E04H 3/20; E03B 11/00

[52] U.S. Cl. ..... 4/172.17; 137/590.5

[58] Field of Search ..... 4/172.17, 255, 172; 137/577, 579, 590.5; 138/32

[56] References Cited

U.S. PATENT DOCUMENTS

| | | | |
|---|---|---|---|
| 2,988,755 | 6/1961 | Roland | 137/577 |
| 3,555,829 | 1/1971 | Trewhella | 137/577 |
| 3,815,160 | 6/1974 | Baker | 4/172.17 |
| 3,858,597 | 1/1975 | Pramenko | 4/172.17 |

FOREIGN PATENT DOCUMENTS

| | | | |
|---|---|---|---|
| 692,033 | 5/1953 | United Kingdom | 4/256 |

*Primary Examiner*—Steven L. Stephan

*Attorney, Agent, or Firm*—Richard D. Emch

[57] ABSTRACT

The disclosure relates to a swimming pool drain chamber which is positioned over an outlet of a swimming pool. The chamber includes sealing means for effecting a liquid seal adjacent the outlet. An upper portion of the chamber extends above the normal water surface of the swimming pool. The water in a line connected to the outlet can be removed without lowering the water level in the entire pool to an elevation below the outlet. In a preferred embodiment, the chamber extends below the outlet to facilitate draining the line completely and also to keep small amounts of water entering the chamber out of this line.

6 Claims, 6 Drawing Figures

SWIMMING POOL APPARATUS

CROSS REFERENCE TO RELATED APPLICATION

This is a continuation-in-part of my copending application Ser. No. 472,214 filed Mar. 22, 1974, now abandoned.

BACKGROUND OF THE INVENTION

Swimming pools, both in ground and above ground, are becoming more prevalent in sections of the country where freezing occurs during winter months. Conduits and equipment connected to the pools, for examples drain lines, recirculating lines and the like, must be drained of all water prior to the freezing season to insure that the conduits and equipment will not freeze and burst.

The most popular prior method of winterizing a swimming pool was to lower the level of the water within the pool to an elevation below the drain line. Often, the water in the drain line was then drained back into the pool or in the alternative removed at, for example, the filtering equipment.

Several thousand gallons of water were lost every year by the lowering of the water levels in the swimming pools to the required elevation to drain the conduits. Besides being time consuming, the cost of water has increased and the overall loss of water was very expensive. In addition, because this water was treated water, its loss was not only expensive but detrimental from a conservation point of view.

SUMMARY OF THE INVENTION

The present invention allows the drain lines and other conduits connected to outlets of a swimming pool to be drained without lowering the normal water level throughout the swimming pool. Apparatus, according to the present invention, comprises a swimming pool drain chamber which is positioned over a drain outlet of the pool. The chamber includes a sealing means for effecting a liquid seal adjacent the pool outlet. An upper portion of the chamber extends above the maximum water surface of the swimming pool. The water in the drain line or other conduit can then be removed without lowering the normal water level in the entire pool to an elevation below the drain outlet. One method for removing the water is to pump all water from the chamber after attachment to the pool. Preferably, the chamber extends below the pool outlet to facilitate completely draining the pool outlet and attached line. The portion of the chamber below the pool outlet also collects any water which may seep into the chamber or the line attached to the pool outlet.

DESCRIPTION OF THE PREFERRED EMBODIMENTS

Figure 2:
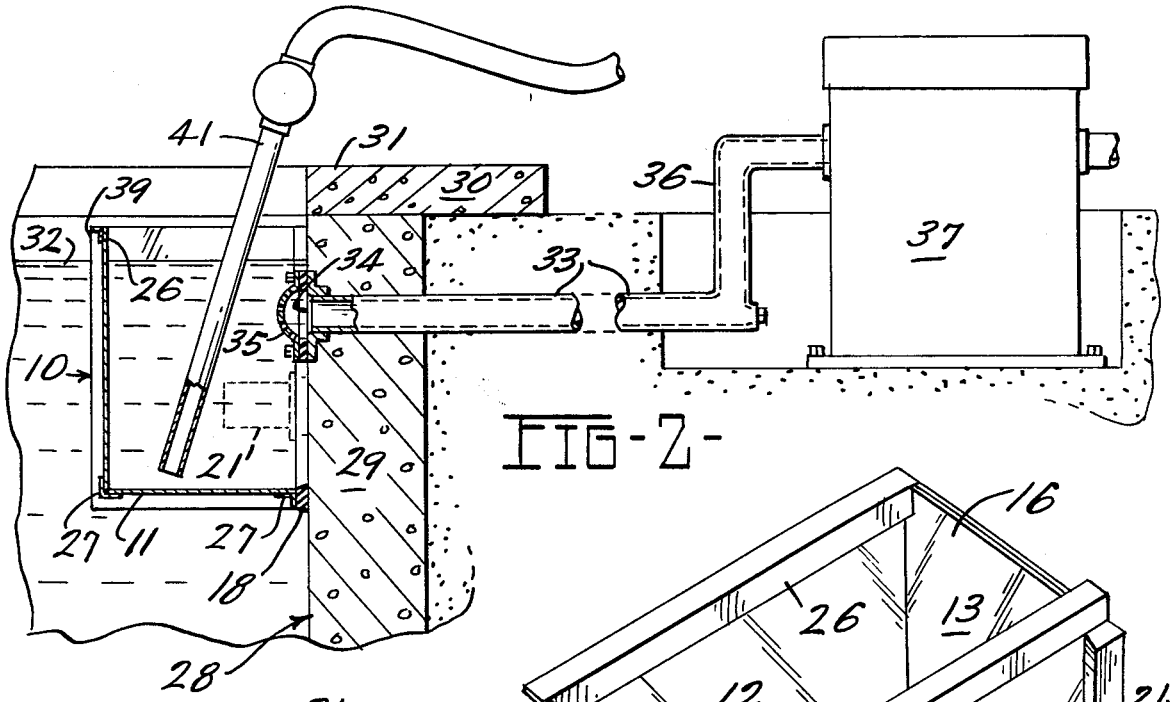
FIG. 2 is a diagrammatic cross-sectional view of the swimming pool apparatus, shown in FIG. 1, installed in a swimming pool.
Figure 3:
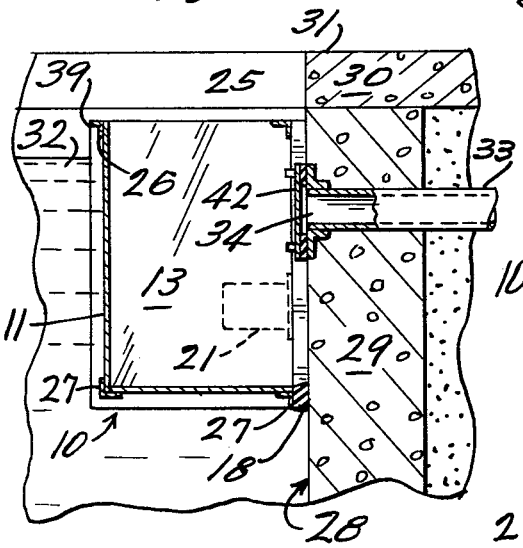
FIG. 3 is a view similar to FIG. 2 showing the swimming pool apparatus in its drained position.
Figure 1:
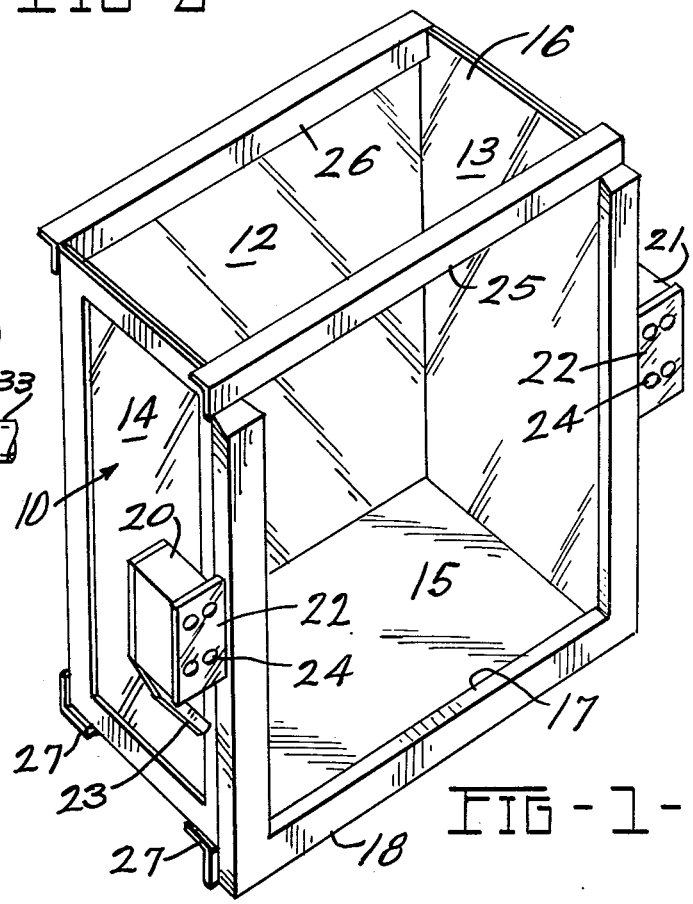
FIG. 1 is a perspective view of a first embodiment of swimming pool apparatus, according to the present invention.

Swimming pool apparatus, according to one embodiment of the present invention, is generally indicated by the reference number 10 in FIGS. 1–3. In this particular embodiment, the swimming pool apparatus 10 comprises a rectangular three-sided watertight box 11. The box 11 includes a front panel 12, two opposing side panels 13 and 14 attached to the front panel 12 and a bottom panel 15. The bottom panel 15 is attached to both the front panel 12 and the side panels 13 and 14. In the present embodiment, the watertight box 11 serves as a chamber means defining an interior chamber 16. The box 11 has an open side 17 opposite the front panel 12. In other embodiments (not shown) an opening comprising only a portion of one side of the box 11 may be provided. A gasket member 18 is mounted adjacent the open side 17 and is attached to the edges of the side panels 13 and 14 and the bottom panel 15. The gasket member 18 may be constructed of any suitable gasketing material which is resilient in nature, for examples, a polyurethane foam, rubber or other elastomeric materials. The gasket member 18, in the present embodiment, serves as a sealing means for providing a watertight seal.

A pair of suction cups 20 and 21 are mounted on the side panels 13 and 14 adjacent the open side 17. The suction cups 20 and 21 are well known in the art. Referring to FIG. 1 a front surface 22 of the suction cup 20 is placed against a surface, for example the wall surface of a swimming pool. A lever 23 is rotated which moves a diaphragm (not shown) within the cup 20 to lower the air pressure within the front portion of the cup 20. Holes 24 are provided in the front surface 22 and the reduction in air pressure urges the suction cup 20 closely adjacent the swimming pool surface of the wall, thereby retaining the box 11 against the wall of the pool.

A reinforcing member, for example an angle 25 extends between the upper edges of the side panels 13 and 14 at a location adjacent the open side 17. In this embodiment, another angle 26 is mounted between the side 13 and 14 adjacent the front panel 12. Similarly, angle reinforcements 27 extend between bottom edges of the side panels 13 and 14 adjacent the front panel 12 and the open side 17, respectively.

Referring specifically to FIGS. 2 and 3, the apparatus 10 is shown installed in a swimming pool, generally indicated by the reference number 28. The swimming pool 28 includes side walls 29 and an upper concrete deck 30 having an upper surface 31. The swimming pool 28 is shown filled with water and has a normal upper water surface level indicated by the reference number 32. While the swimming pool apparatus 10, according to the present invention, is suitable for use in draining several different types of swimming pool conduits or lines, FIGS. 2 and 3 illustrate the use of the apparatus 10 in connection with the draining of a line 33 which extends through one of the side walls 29. The line 33 has an outlet 34 which may be covered with a beehive grill 35 to prevent foreign objects from entering the outlet. In the swimming pool 28 illustrated, the line 33 is connected by a conduit 36 to a filtering assembly 37 where the pool water is filtered. A second line 38 is connected from the filter 37 to the pool 28. One of the lines 33 or 38 drains water to be filtered from the pool 28 while the other line 38 or 33 returns the filtered water to the pool.

In many prior art structures, to drain the line 33, conduit 36, the filtering assembly 37 and the line 38 in preparation for a freezing season, it is necessary to lower the upper water surface level 32 to a point below the outlet 34. As mentioned above, this is both wasteful and expensive.

According to the present invention, the box 11 is positioned in surrounding relationship to the outlet 34. During this operation, the swimming pool water elevation is maintained at the normal elevation indicated by the reference number 32. The suction cups 20 and 21 are activated with the surfaces 22 of the cups 20 and 21 in contacting relationship with the swimming pool sidewall 29. The cups 20 and 21 removably mount the box 11. The gasket member 18 is compressed against the sidewall 29 and serves as a watertight seal to prevent the transfer of water from the main portion of the swimming pool 28 into the interior chamber 16 of the watertight box 11. The swimming pool apparatus 10 includes an upper portion 39 which extends above the normal upper water elevation 32 of the swimming pool 28.

Water within the interior chamber 16 of the watertight box 11 may then be removed by, for example, a pump assembly 31, as shown in FIG. 2. The drain line 33 and its connected conduits are drained without lowering the normal water level 32 of the swimming pool 28. After the lines are drained, the swimming pool apparatus 10 may be removed from the swimming pool 28, or in the alternative, left within the pool. In the present embodiment, referring to FIG. 3, after the lines are drained, the beehive grill 35 is removed and replaced with a blind flange 42. After the flange 42 is installed, the box 11 is removed.

Figure 4:
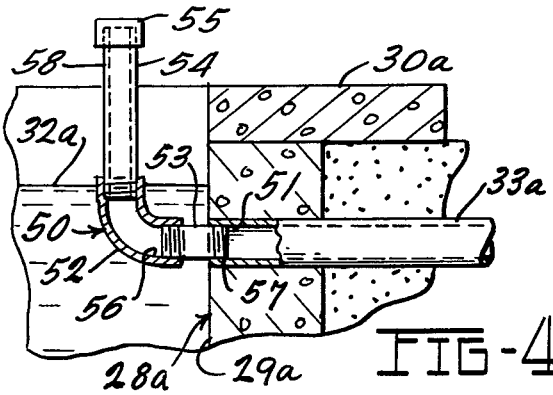
FIG. 4 is a partial cross-sectional view showing a second embodiment of swimming pool apparatus, according to the present invention, utilized in a swimming pool.

A second embodiment of swimming pool apparatus according to the present invention is generally indicated in FIG. 4 by the reference number 50. A swimming pool 28*a* having sidewalls 29*a* and a deck 30*a* is shown filled with water to a normal upper water elevation 32*a*. A line 33*a* extends through the sidewall 29*a* and has an internally threaded outlet 51. The swimming pool apparatus 50 includes a pipe elbow 52 which is threadably engaged to one end of a pipe nipple 53. A standpipe 54 is threadably attached to the upper leg of the elbow 52. A removable cap 55 is positioned on the upper end of the standpipe 54. The nipple 53, elbow 52 and standpipe 54 serve as chamber means and define and interior chamber 56. The free end of the pipe nipple 53 includes pipe threads 57 which engage the threaded outlet 51. The threads 57 serve as sealing means for effecting a liquid seal to prevent the entrance of swimming pool water into the interior chamber 56. An upper portion 58 of the swimming pool apparatus 50 extends above the maximum swimming pool water elevation 32*a*. After the swimming pool apparatus 50 is installed, as shown in FIG. 4, the cap 55 is removed and the line 33*a* is drained, for example, by inserting the intake of the pump assembly 41 directly into the interior chamber 56. The cap 55 is then replaced to prevent water such as rain or snow from entering the chamber 56.

Figure 5:
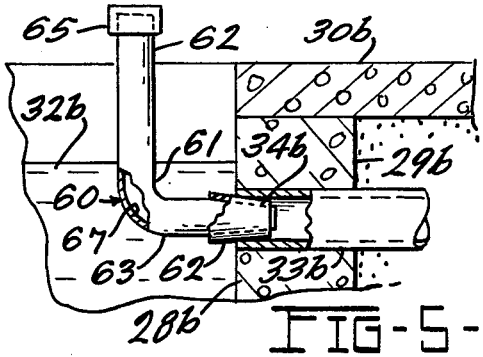
FIG. 5 is a view similar to FIG. 4 showing a third embodiment of swimming pool apparatus, according to the present invention.

Still another embodiment of swimming pool apparatus, according to the present invention, is indicated in FIG. 5 by the reference number 60. The swimming pool apparatus 60 is shown installed in a swimming pool 28*b* which includes sidewalls 29*b* and a deck 30*b*. Water within the swimming pool has a maximum surface level 32*b*. A line 33*b* extends through the sidewall 29*b* and has an outlet 34*b*. The swimming pool apparatus 60 includes an elongated elbow 61 having outwardly extending legs 62 and 63. A sealing gasket sleeve 64 having a frusto conical shape is positioned on the leg 63 adjacent its end. The leg 63 is inserted within the outlet 34*b* until the resilient sealing gasket 64 forms a tight friction fit. A removable cap 65 is positioned on an upper portion 66 of the leg 62. The upper portion 66 extends above the maximum water surface level 32*b* of the swimming pool 28*b*. The elongated elbow 61 serves as a chamber means and defines an interior chamber 67.

When it is desired to remove water from the line 33*b*, the cap 65 is removed and, for example, the intake of a pump assembly is inserted into the interior chamber 67. The sealing gasket 64 effects a liquid seal preventing the entrance of swimming pool water into the interior chamber 67. Pumping continues until the line 33*b* and connecting conduits are drained. Once the chamber 67 is drained, pressure exerted by the surrounding pool water urges the leg 63 and the sealing gasket 64 into the outlet 34*b* to help maintain the watertight seal.

Figure 6:
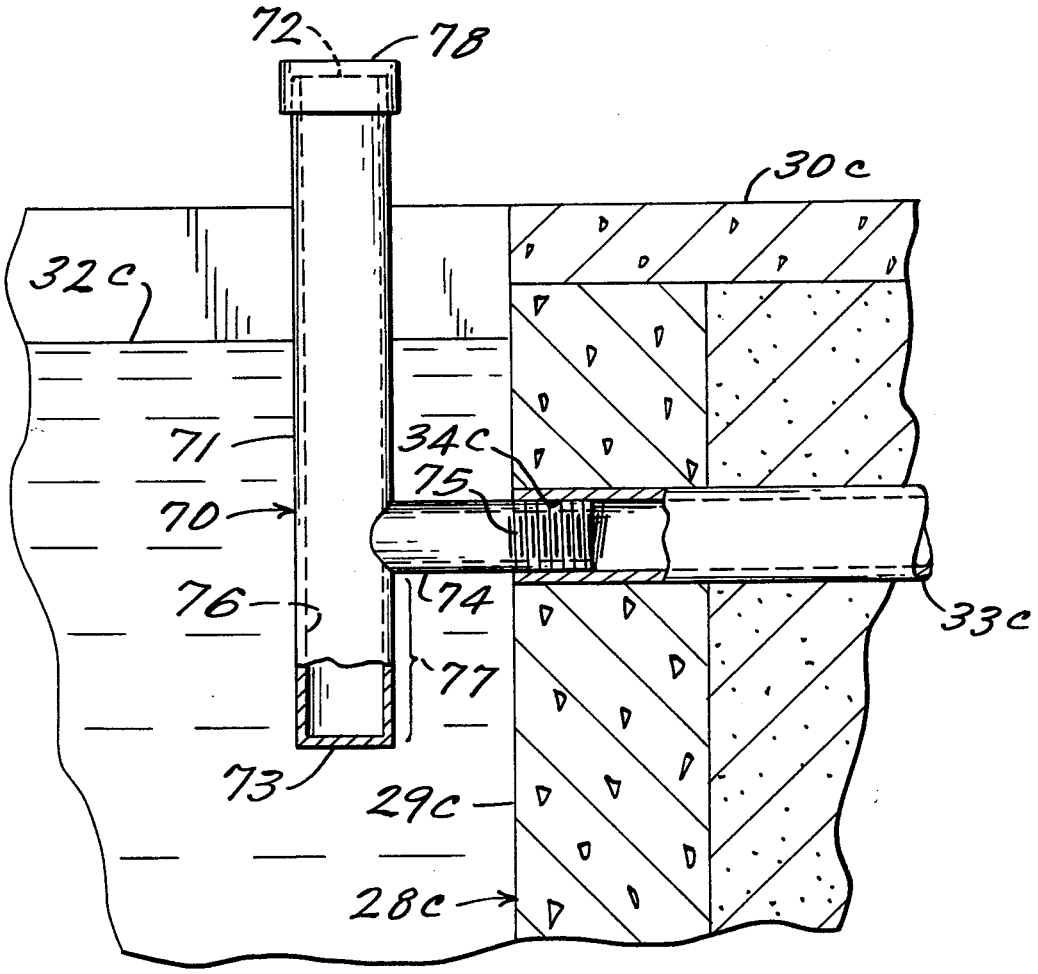
FIG. 6 is a view similar to FIGS. 4 and 5 showing a fourth embodiment of swimming pool apparatus, according to the present inventions.

FIG. 6 shows still another embodiment of swimming pool apparatus 70 constructed in accordance with the present invention. The swimming pool apparatus 70 is shown installed in a swimming pool 28*c* which includes sidewalls 29*c* and a deck 30*c*. The swimming pool 28*c* is filled with water up to a predetermined maximum surface level 32*c*. A line 33*c* extends through the pool sidewall 29*c*. The line 33*c* is provided with an outlet 34*c* which is internally threaded with a standard pipe thread.

The swimming pool apparatus 70 includes a first tubular conduit or pipe 71 having an open upper end 72 and a closed lower end 73. A second pipe 74 extends perpendicularly from the first pipe 71 at a point intermediate the ends 72 and 73. The pipe 74 is spaced a distance above the end 73 and is also spaced below the end 72 by a distance greater than the distance to the maximum water surface level 32*c*. The pipe 74 is provided with a threaded end 75 having an external pipe thread adapted to threadably engage the internally threaded pool outlet 34*c*. When the threaded pipe end 75 is attached to the pool outlet 34*c*, the line 33*c* is in communications with a chamber 76 within the pipe 71. The threaded pipe end 75 and the threaded pool outlet 34*c* cooperate to form a watertight seal to prevent pool water from entering the chamber 76 and the line 33*c*. It should be noted that the chamber 76 has a lower section or storage reservoir 77 which extends below the pipe section 74 and the pool line 33*c*.

Before the water in the pool 28*c* freezes in the fall or winter, the apparatus 70 is attached to the pool outlet 34*c* by means of the threaded end 75 of the pipe 74. When the apparatus 70 is attached to the pool outlet 34*c*, the open end 72 extends above the maximum water surface level 32*c*. A pump (not shown) is then inserted through the open end 72 and to the bottom of the lower chamber section 77. The pump may be of any conventional design, such as an electric water pump or a manual pump such as those used for bailing boats, or the like. The pump is then operated to drain the line 33*c* and the chamber 76. After draining, the pump is removed from the chamber 76 and a cap 78 is placed over the open end 72 of the pipes 71. The cap 78 functions to keep rain and snow from entering the chamber 76 and need not form a tight seal with the tube 71. If small amounts of water should enter the line 33*c* or the apparatus 70, such water will collect in the lower chamber section or storage reservoir 77 rather than in the line 33*c*. This protects the line 33*c* from damage if such water should freeze.

In the following claims, the term "outlet" is used to describe an opening in the side of a swimming pool. "Outlet" is intended to define any opening in the pool regardless of its function in supplying water from a line to the pool or from the pool to a line. Such line may be connected, for example, to a water utility main, to water filtering apparatus or to a drain.

What I claim is:

1. Swimming pool apparatus for use on a pool filled with water up to a predetermined maximum level and having a side outlet positioned below the normal surface of the water in the pool, such outlet normally being filled with water, comprising, in combination, chamber means including a rectangular watertight box having an opening in one side for positioning in alignment with a pool outlet, sealing means for effecting a liquid seal between said chamber means and the pool adjacent the pool outlet, said sealing means including a gasket mounted on said watertight box adjacent such side opening, said sealing means preventing the pool water from entering said chamber means and the pool outlet, said chamber means including an upper portion which extends above the predetermined maximum water surface level when said chamber means is sealed to the pool, said upper portion defining an opening located above the predetermined maximum water surface level, said chamber means further including a lower portion which extends below the pool outlet when said watertight means is sealed to the pool whereby, when said chamber means is sealed to the pool with said sealing means and is drained to below the pool outlet, the pool outlet is drained without lowering the normal water surface level, and suction cup means mounted on opposed sides of said watertight box for removably mounting said watertight box in a surrounding relationship with the pool outlet.

2. Swimming pool apparatus for use on a pool filled with water up to a predetermined maximum level and having a side outlet positioned below the normal surface of the water in the pool, such outlet normally being filled with water, comprising, in combination, chamber means including a front panel, two opposing side panels attached to said front panel and a bottom panel attached to said front and side panels, said chamber means defining an interior chamber, an open top for positioning above the predetermined maximum water surface level of the pool and an open side opposite said front panel, gasket means mounted adjacent such open side for sealing such interior chamber to the pool, and suction cup means mounted on said side panels adjacent such open side for attaching said apparatus to said pool with said open side in alignment with the pool outlet.

3. Swimming pool apparatus, according to claim 2, including a reinforcing member extending between the upper edges of said side panels, adjacent such open side.

4. Apparatus for use in a swimming pool filled with water up to a predetermined maximum level and having a side outlet positioned below the normal surface of the water in the pool, such outlet normally being filled with water, comprising a first tubular conduit defining a chamber, said conduit having an open end and a closed end, a second tubular conduit having two ends and an internal opening extending therethrough, means connecting one end of said second conduit to said first conduit at a point intermediate said open and closed ends with said second conduit spaced from said open end by a distance greater than the distance from the pool outlet to the predetermined maximum water level, said first tubular conduit defining a storage reservoir below the lowest portion of said second tubular conduit, said opening in said second conduit communicating with said chamber in said first conduit and means for sealing the other end of said second conduit to the pool outlet with said open end of said first conduit located above the predetermined maximum water level whereby, when said chamber is emptied by water, said pool outlet is drained and any excess water is stored in said storage reservoir.

5. The apparatus of claim 4, wherein said means for sealing other end of said second conduit to the pool outlet includes thread means on said other end of said second conduit for threadably engaging the pool outlet.

6. The apparatus of claim 5, and further including removable cap means for closing said open end of said first conduit.

* * * * *